US005695119A

United States Patent [19]

Lien

[11] Patent Number: 5,695,119

[45] Date of Patent: Dec. 9, 1997

[54] FOUNTAIN DEVICE WITH WATER SCREEN CIRCULATING AND ALTERNATING MECHANISM

[76] Inventor: Ching-Yang Lien, P.O. Box 1-394, Chungho, Taipei Hsien, Taiwan

[21] Appl. No.: 593,400

[22] Filed: Jan. 29, 1996

[51] Int. Cl.[6] ..... B05B 17/08

[52] U.S. Cl. ..... 239/17; 239/16; D23/201

[58] Field of Search ..... 239/16, 17; D23/201

[56] References Cited

U.S. PATENT DOCUMENTS 3,506,196 4/1970 Ramsey ..... 239/17
5,524,822 6/1996 Simmons ..... 239/17

*Primary Examiner*—Andres Kashnikow
*Assistant Examiner*—Lisa Ann Douglas

[57] ABSTRACT

This invention relates to a fountain device with water screen circulating and alternating mechanism which is composed of a water supply device, a fountain base, a water screen circulating and alternating mechanism and at least one or more nozzles, wherein the water supply device containing a spurt water stand, a reservoir and a water pump, the fountain base having a water inlet connected to the water pump and a plurality of water holes, which being installed on the water supply device, the water screen circulating and alternating mechanism being composed of a rotary shaft in which having a water diversion hole and an eccentric trumpet water diversion outlet, a drive wheel having a plurality of radial plates and a drive worm connected with the shaft of the drive wheel and engaged with a worm gear installed at the circumference of the rotary diversion shaft, furthermore each nozzle having a plurality of nozzle inlets connected to the water holes of the fountain base, water being led to each nozzle and the radial plates, the drive wheel can be rotated by hydraulic power to drive the rotary diversion shaft, thus the trumpet water diversion outlet can aim at the water holes by turns so that water led to each nozzle can spurt out to form various water screen when the rotary diversion shaft being rotated.

6 Claims, 6 Drawing Sheets

FOUNTAIN DEVICE WITH WATER SCREEN CIRCULATING AND ALTERNATING MECHANISM

BACKGROUND OF THE INVENTION

This invention relates to a fountain device with water screen circulating and alternating mechanism.

The conventional fountain device always use a water pump for pumping water to a nozzle continuously, then water spurting out from the nozzle to form a water screen, but such kind of conventional fountain device only can provide single water screen. As to the electronic control fountain device, that is a fountain device controlled by a circuit board, the alternation of water screen can be controlled by the circuit board. The structure and installation of such kind of electronic control fountain device is very complex, such that, the maintenance of operation of the electronic control fountain device must be made by the professionals.

SUMMARY OF THE INVENTION

It is therefore the main object of this invention to provide a fountain device with water screen circulating and alternating mechanism which is composed of a water supply device having a spurt water stand, a reservoir and a water pump, a fountain base having a water inlet connected to the water pump and a plurality of water holes, a water screen circulating and alternating mechanism comprising a rotary diversion shaft installed inside the fountain base and can be rotated, in the rotary diversion shaft having a water diversion hole and an eccentric trumpet water diversion outlet, a drive wheel having a plurality of radial plates and a drive worm connected with the shaft of the drive wheel and engaged with a worm gear installed at the circumference of the rotary diversion shaft, at least one or more nozzles, each nozzle having a plurality of nozzle inlets connected to the water holes of the fountain base, water being led to each nozzle and the radial plates, thus the drive wheel can be rotated by hydraulic power to drive the rotary diversion shaft, thus the trumpet water diversion outlet can aim at the water holes by turns, so that water led to each nozzle can spurt out to form various water screen when the rotary diversion shaft being rotated.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENT

Figure 1:
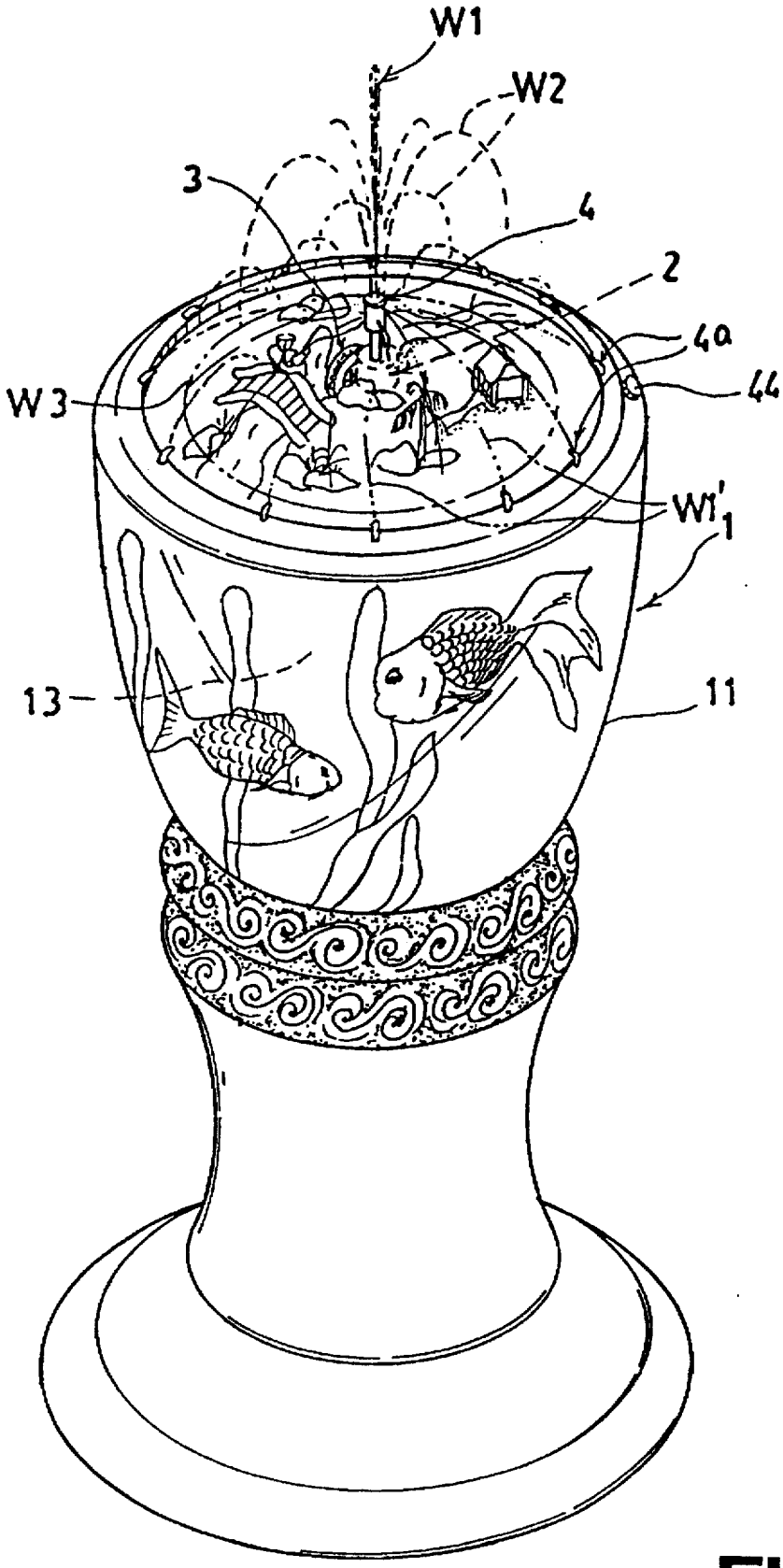
FIG. 1 is a perspective view showing my present invention "a fountain device with water screen circulating and alternating mechanism"

Referring to FIG. 1 to FIG. 5, the present invention "a fountain device with water screen circulating and alternating mechanism" is composed of a water supply device (1), a fountain base (2) fixed on the water supply device (1), a water screen circulating and alternating mechanism (3) and at least one or more nozzles (4), wherein the water supply device (1) can be a fountain or a spurt water stand (11), which is composed of a reservoir (12) for storing water, a water pump (13) for pumping water through a water outlet (131) into the fountain base (2) and flowing to the nozzles (4) to spurt out.

The fountain base (2) is fixed on the water supply device (1), in the fountain base (2) having a central empty part (21), the central empty part (21) having a water inlet (211) which is connected with the water outlet (131) of the water pump (13), furthermore the top of the fountain base (2) having a plurality of water holes (22) led to the central empty part (21).

The water screen circulating and alternating mechanism (3) is composed of a rotary diversion shaft (31) installed on the central empty part (21) of the fountain base (2), a worm gear (32) situated at the lower circumference of the rotary diversion shaft (31), a pair of bearings (33), a drive device (34) and a locating seat (35), wherein the rotary diversion shaft (31) being installed in the central empty part (21) of the fountain base (2), in the rotary diversion shaft (31) having a water diversion hole (311), the end of the water diversion hole (311) being connected with a trumpet water diversion outlet (312) situated eccentrically with the central line of the rotary diversion shaft (31).

The bearings (33) are installed respectively at two ends of the rotary diversion shaft (31), each end of the rotary diversion shaft (31) having a thread post (331) which can be screwed respectively into the thread holes (23) situated at the top and the bottom of the fountain base (2) to push the rolling balls (332) respectively into the receiving grooves (310) formed at two ends of the rotary diversion shaft (31), thus the rotary diversion shaft (31) can be rotated in the fountain base (2) freely. The drive device (34) is composed of a rotary wheel (341) on which have a plurality of radial plates (341*a*) for receiving the water from a drive water outlet (221) so that the the rotary wheel (341) can be rotated by hydraulic power, a drive worm (342) connected with the central shaft of the rotary wheel (341) and can be rotated with the rotary wheel (341), the central shaft being fitted with a shaft bushing (343). The locating seat (35) being fixed on the circumference of the fountain base (2) by means of a screw, furthermore the locating seat (35) having a through hole (351) formed therein, the drive worm (342) being located and gone through the through hole (351) to engage with the worm gear (32), such that, the rotary wheel (341) can drive the rotary diversion shaft (31) to rotate in the central empty part (21) of the fountain base (2) by means of the transmission of the drive worm (342) and the worm gear (32).

Figure 4:
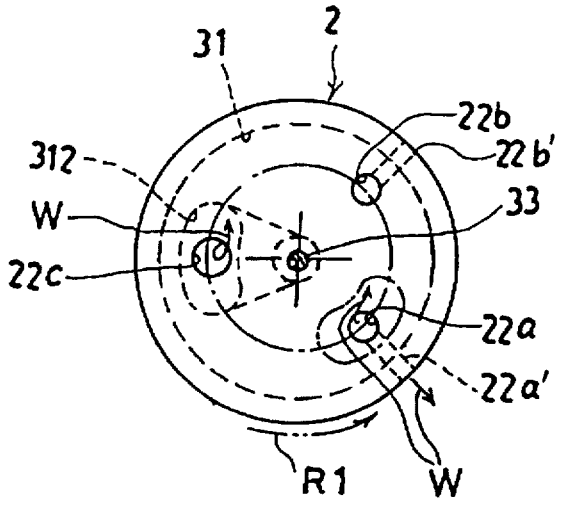
FIG. 4 is a top plan view showing a fountain base and a rotating diversion tube of this invention.
Figure 5:
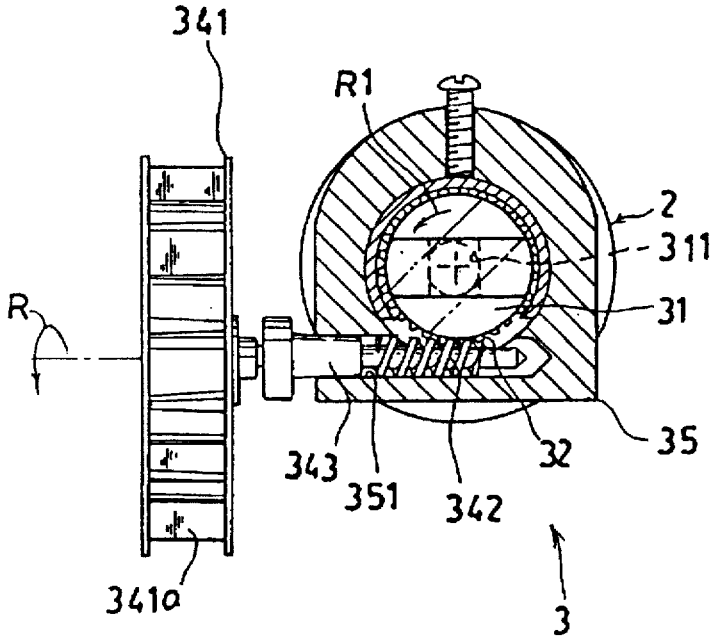
FIG. 5 is a plan view showing an automatic circulating device of this invention.

Referring to FIG. 4 and FIG. 5, if rotary wheel (341) is rotated in the direction of arrow (R) by means of hydraulic power, the drive worm (342) would drive the worm gear (32) to rotate in the direction of arrow (R1), thus the rotary diversion shaft (31) can be rotated in the direction of arrow (R1) slowly, thus the trumpet water diversion outlet (312) can aim at the water holes (22) by turns. If the trumpet water diversion outlet (312) aim at the third water hole (22*c*), water would spurt out from the third water hole (22*c*), meanwhile the first water hole (22*a*), the second water hole (22*b*), the first auxiliary water hole (22*a*') and the second auxiliary hole (22*b*') having no water to supply. As the trumpet water diversion outlet (312) rotates to aim at the the first water hole (22*a*), water would spurt out from the first water hole (22*a*) and the first auxiliary water hole (22*a*'), meanwhile the other water holes having no water to supply, such that, water can be supplied to each water holes (22) one time when the rotary diversion shaft (31) rotates per rotation.

Figure 7:
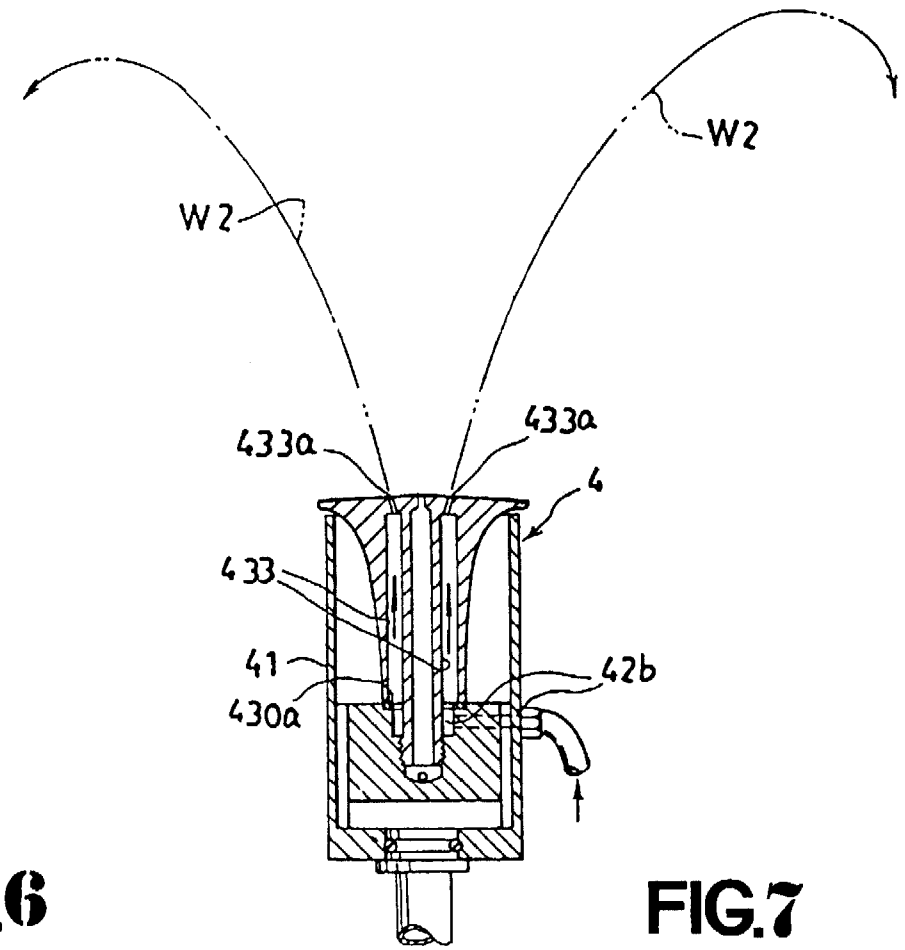
FIG. 7 is a plan sectional view showing another kind of water screen of this invention.
Figure 6:
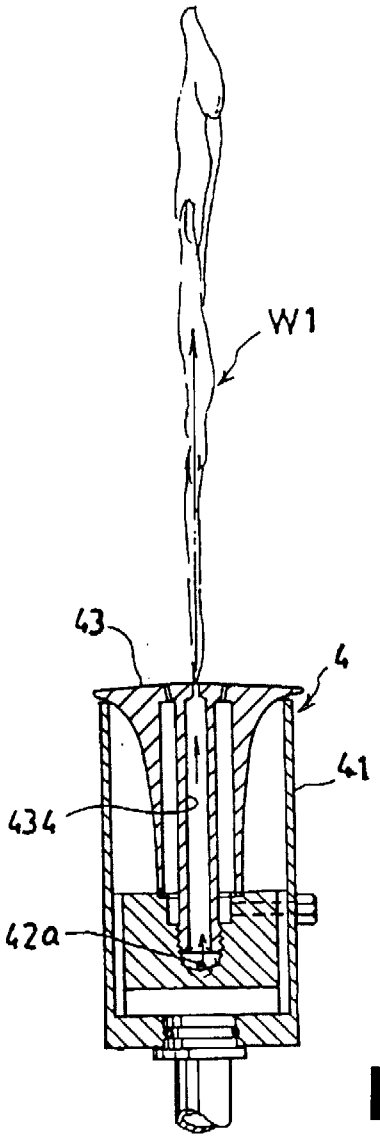
FIG. 6 is a plan sectional view showing a water screen of this invention.
Figure 8:
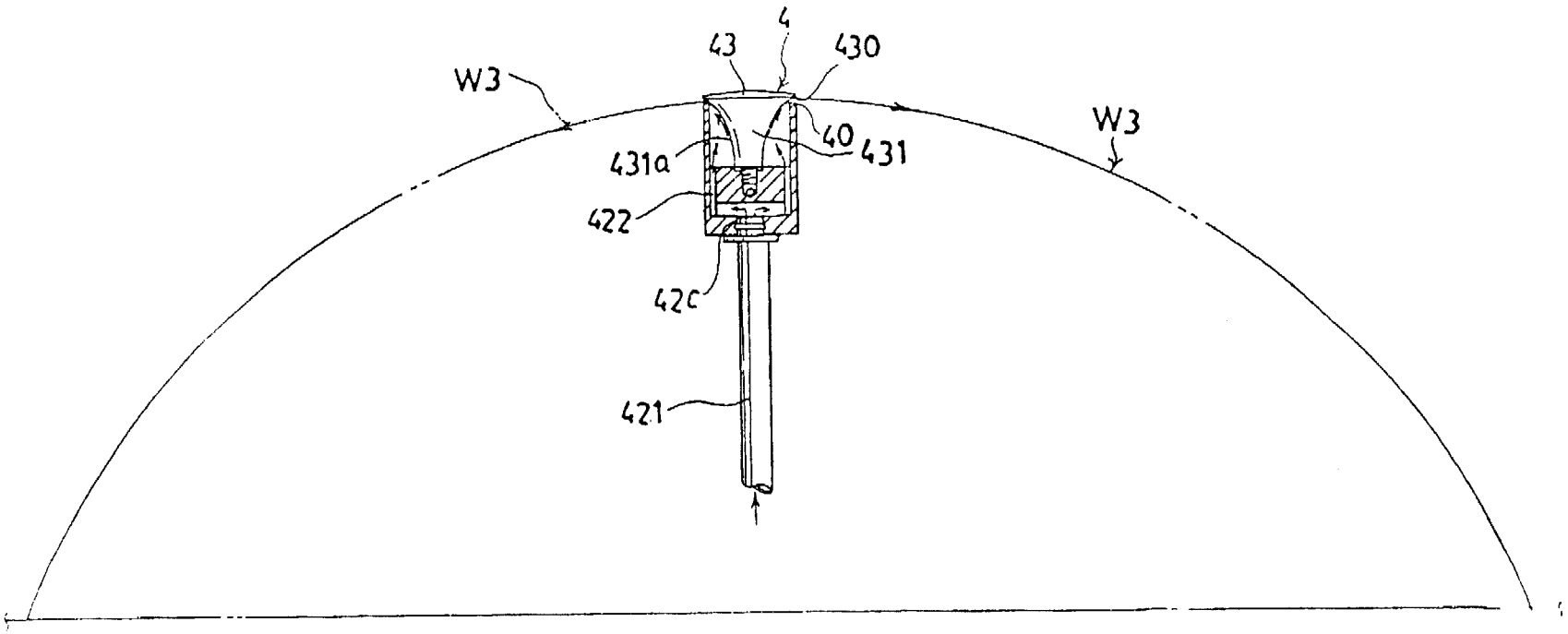
FIG. 8 is a plan sectional view showing still another kind of water screen of this invention.

The nozzles (4) are connected to the water holes (22), each nozzle (4) being composed of a cylindrical body (41) and a cover body (43), the top of the cylindrical body (41) having an aperture (40) and the bottom having a third nozzle inlet (42*c*), the third nozzle inlet (42) being connected to the third water outlet (22*c*) by means of a water tube (421), furthermore the inner circumference of the cylindrical body (41) having a plurality of guide holes (422) so as to make water flowed into the third nozzle inlet (42*c*) can be led to the upper part of the cylindrical body (41), in addition, the inner center of the cylindrical body (41) having a second nozzle inlet (42*b*), the second nozzle inlet (42*b*) being connected to the second water hole (22*b*) by means of a water hose. The cover body (43) is inserted into the cylindrical body (41) from the aperture (40), the bottom of the cover body (43) having a male thread part (432) which can be screwed into the female thread hole (411) in the cylindrical body (41), the circumference of the cover body (43) being formed into parabolic curve (431), furthermore, between the aperture (40) of the cylindrical body (41) and the upper end (43*a*) of the cover body (43) having a clearance (430) when the cover body (43) is inserted into the cylindrical body (41), thus water can flow along the parabolic curve (431) and spurt out from the clearance (430) to form a parabolic water screen (W3), such as shown in FIG. 8. Inside the cover body (43) have two side water passages (433) and a central water passage (434), the top of each side water passage (433) having a plurality of spurt holes (433*a*), such that, the water came from the second nozzle inlet (42*b*) can be led to the side water passages (433) and spurt out from these spurt holes (433*a*) to form a dispersive water screen (W2), such as shown in FIG. 7. The first nozzle inlet (42*a*) of the nozzle (4) is led to the bottom of the central water passage (433), furthermore the first nozzle inlet (42*a*) being connected to the first water hole (22*a*) by means of a water hose, such that, the water came from the first water hole (22*a*) can be transported to the first nozzle inlet (42*a*) and led to the central water passage (433) to spurt out, such as shown in FIG. 6.

Between the bottom of the cover body (43) and the cylindrical body (41) have a water seal (430*a*) so as to prevent water in the second nozzle inlet (42*b*) from flowing to the third nozzle inlet (42*c*), furthermore water in the third nozzle inlet (42*c*) can be blocked up to flow to the second nozzle inlet (42*c*) by means of the joint of male thread part (432) and the female thread hole (411).

Figure 2:
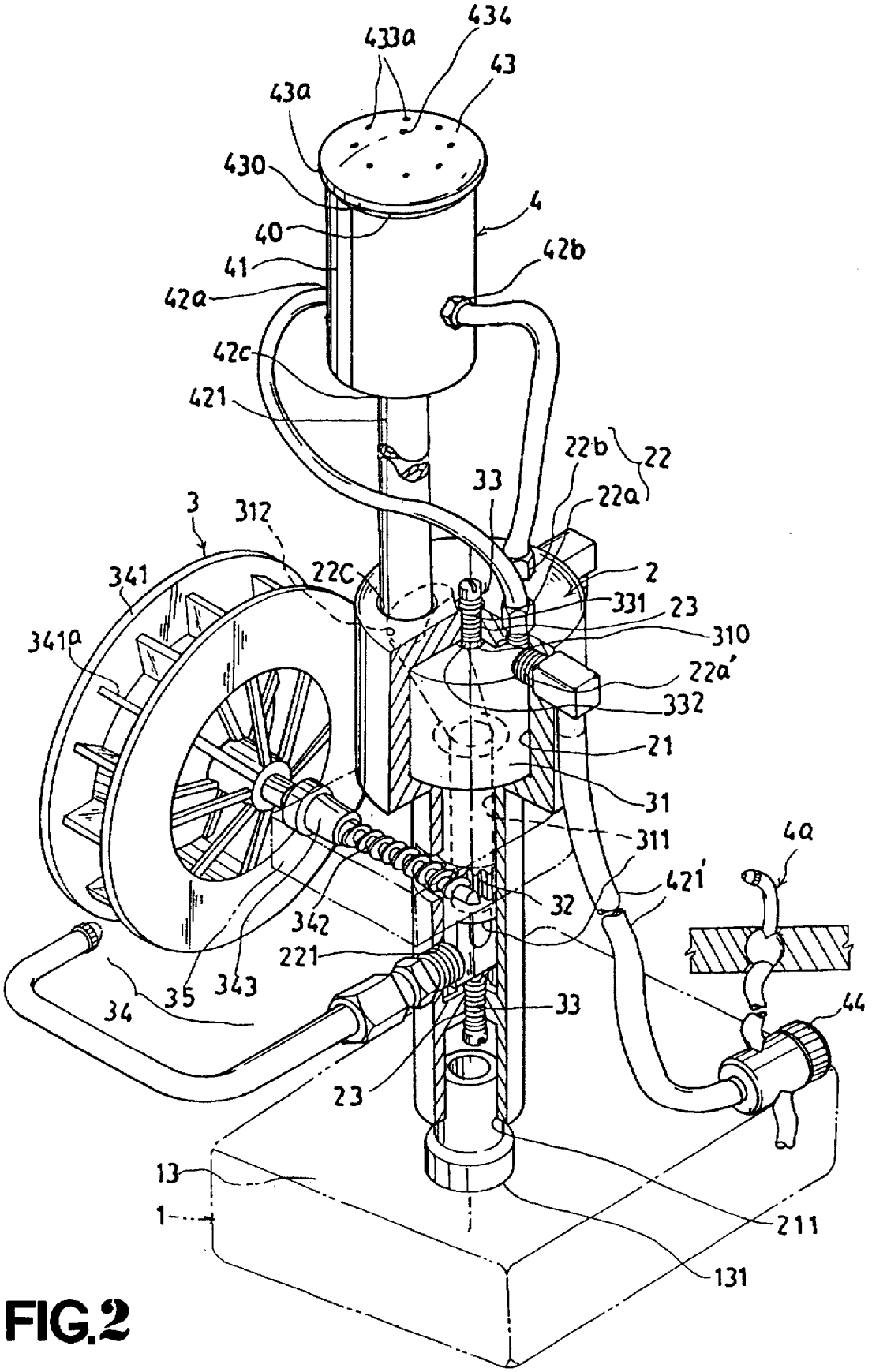
FIG. 2 is a partial sectional view of this invention.
Figure 3:
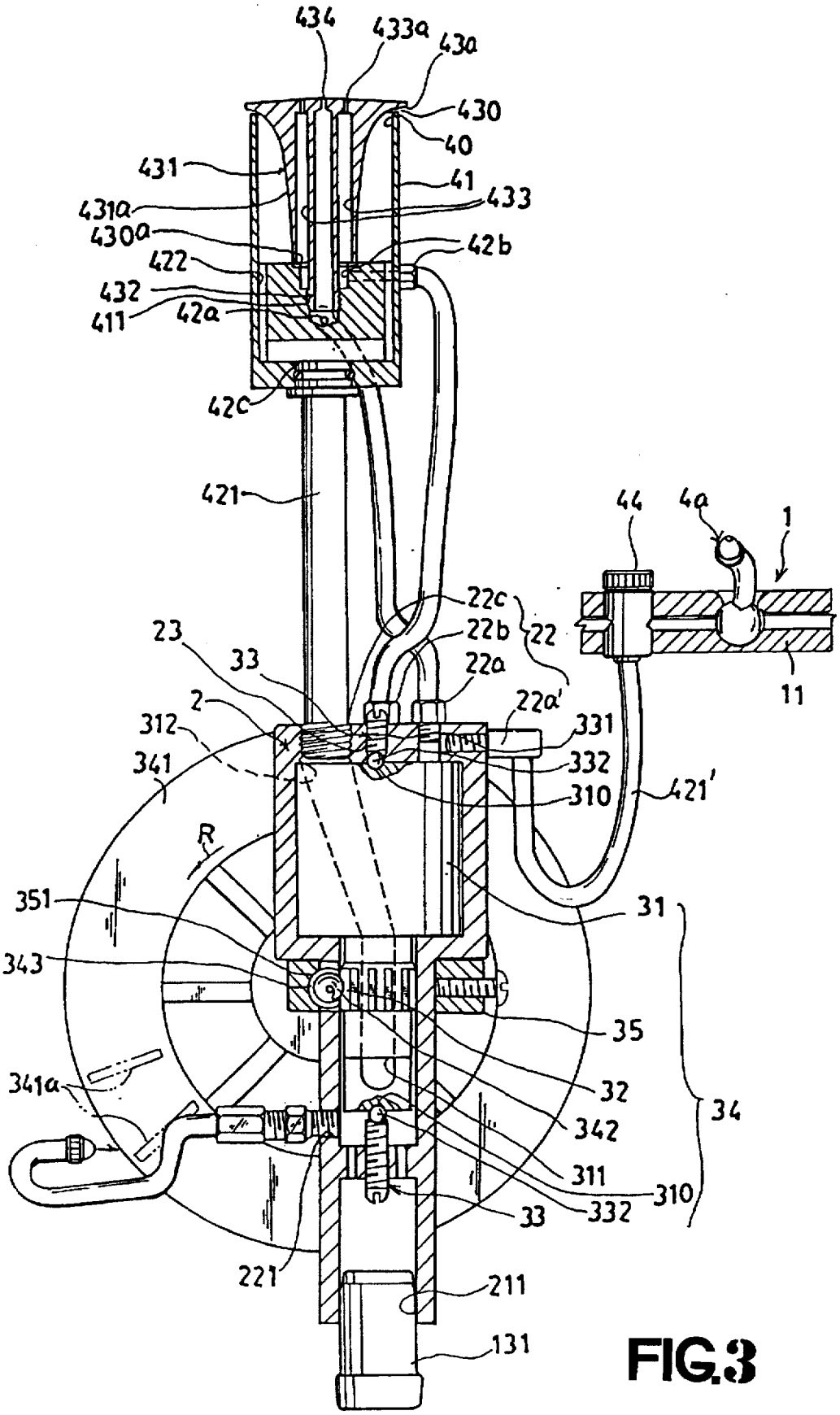
FIG. 3 is a plan sectional view of this invention.

Referring to FIG. 1, FIG. 2 and FIG. 3, the first water hole (22*a*) is led to the first water auxiliary hole (22*a*') and the second water hole (22*b*) is led to the second water auxiliary hole (22*b*'), thus the first water auxiliary hole (22*a*') or the second water auxiliary hole (22*b*') can be connected respectively to at least one or more auxiliary nozzles (4*a*) by means of an auxiliary water hose (421'), furthermore the auxiliary water hose (421') being equipped with a control valve (44) so as to control the necessary flow quantity of these auxiliary nozzles (4*a*), such that, water can be supplied simultaneously to the nozzle (4) and the auxiliary nozzles (4*a*') when the trumpet water diversion outlet (312) rotates to aim at the first water hole (22*a*) or the second water hole (22*b*). In addition, these auxiliary nozzles (4*a*) are installed on the spurt water stand (11).

Accordingly, the water supply device (1) can be a spurt water stand (11) in which have a reservoir (12) and a water pump (13). The fountain base (2), the water screen circulating and alternating mechanism (3) both are installed at the center of the spurt water stand (11), at the edge of the spurt water stand (11) having a plurality of auxiliary nozzles (4*a*). As the water pump (13) is starting, water can be pumped into the fountain base (2) and the rotary diversion shaft (31), meanwhile water also flow through the drive water outlet (221) to push the drive wheel (341) and the drive worm (342) to rotate, such that, the rotary diversion shaft (31) can be rotated continuously to make the trumpet water diversion outlet (312) aim at the water holes (22) by turns. As the trumpet water diversion outlet (312) is aiming at the first water hole (22*a*), water flows through the first water hole (22*a*) and the first auxiliary water hole (22*a*') to the central water passage (434) of the nozzle (4) and the auxiliary nozzle (4*a*'), such that, water would spurt out from the central water passage (434) to form a water screen (W1) shown in FIG. 1, furthermore water also spurting out from these auxiliary nozzles (4*a*) toward the center of the spurt water stand (11) to form another water screen (W1'). As the trumpet water diversion outlet (312) is aiming at the second water hole (22*b*), water flows through the second water hole (22*b*) to the second nozzle inlet (42*b*) by means of a water hose, then water flowing into the side water passages (433) and spurting out from the spurt holes (433*a*) to form a dispersive water screen (W2) shown in FIG. 7. As the trumpet water diversion outlet (312) is aiming at the third water hole (22*c*), water flows through the water tube (421) into the third nozzle inlet (42*c*) and led to the guide holes (422), thus water can flow along the parabolic curve (431) and spurt out from the clearance (430) to form a parabolic water screen shown in FIG. 8. Accordingly, the spurt water stand (1) can show various water screen when the rotary diversion shaft rotates per rotation.

What is claimed is:

1. A fountain device with water screen circulating and alternating mechanism comprising:

a water supply device which is composed of a spurt water stand, a reservoir and a water pump;

a fountain base fixed on said water supply device, inside the fountain base having a central empty part with a water inlet connected to said water pump, said fountain base having a plurality of water holes led to said central empty part, furthermore said fountain base having a water inlet connected with said water pump and a drive water outlet;

a water screen circulating and alternating mechanism comprising a rotary diversion shaft installed in said central empty part of said fountain base, a worm gear fixed at the circumference of said rotary diversion shaft, a pair of bearings installed between two ends of said rotary diversion shaft and said central empty part, a drive device and locating seat, wherein said rotary diversion shaft having a water diversion hole, the end of said water diversion hole being connected with a trumpet water diversion outlet, said drive device being composed of a rotary wheel with a plurality of radial plates, a drive worm connected with the shaft of said rotary wheel and engaged with said worm gear;

at least one or more nozzles, said nozzles being connected to said water holes of said fountain base by water hose, each nozzle being composed of a cylindrical body and a cover body, said cylindrical body having an aperture formed at its top and a first nozzle inlet, a second nozzle inlet and a third nozzle inlet connected respectively to said water holes, furthermore said cylindrical body having a plurality of guide holes formed at its inner circumference so as to make water flowed into said third nozzle inlet can be led to upper part of said cylindrical body, said cover body being inserted into said cylindrical body, furthermore, between the aperture of said cylindrical body and the upper end of said cover body having a clearance;

the above fountain device with water screen circulating and alternating mechanism characterized in that: water came from said drive water outlet being led to said of radial plates to rotate said drive wheel and said drive worm, meanwhile said rotary diversion shaft can be rotated slowly in said central empty part of said fountain base, thus said trumpet water diversion hole can aim at each said water hole by turns when said rotary diversion shaft rotates per rotation, furthermore water came from said water holes being led respectively said nozzles to form various water screen.

2. A fountain device with water screen circulating and alternating mechanism as claimed in claim 1, wherein said locating seat is fixed on the circumference of said fountain base, inside said locating seat having a through hole, said drive worm being located and gone through said through hole to engage with said worm gear installed on said rotary diversion shaft.

3. A fountain device with water screen circulating and alternating mechanism as claimed in claim 1, wherein said cover body having a male thread part which can be screwed into a female thread hole in said cylindrical body, furthermore, circumference of said cover body being formed into parabolic curve, thus water flowed into said third nozzle inlet can be led through said guide holes to said parabolic curve, then water can flow along said parabolic curve and spurt out from said clearance to form a parabolic water screen.

4. A fountain device with water screen circulating and alternating mechanism as claimed in claim 1, wherein said cover body of each said nozzle have two side water passages and a central water passage formed therein, said side water passages being led to said second nozzle inlet, furthermore each side water passage having a plurality of spurt holes formed at its top, such that, water came from said nozzle inlet can be led to said side water passages and spurt out from said spurt holes to form a dispersive water screen, said first nozzle inlet being led to bottom of said central water passage, such that, water came from one of said water holes can be transported to said first nozzle inlet and led to said central water passage to spurt out.

5. A fountain device with water screen circulating and alternating mechanism as claimed in claim 1 or claim 4, wherein the bottom of said cover body and the cylindrical body have a water seal so as to prevent water in said second nozzle inlet from flowing to said third nozzle inlet, water in said third nozzle inlet can be blocked up to flow to said second nozzle inlet by means of the joint of said male thread part and said female thread hole.

6. A fountain device with water screen circulating and alternating mechanism as claimed in claim 1 or claim 4, wherein said water holes can be led respectively to an auxiliary water hole, each said auxiliary water hole can be connected to at least one or more auxiliary nozzles by water hose, thus water can flow to said water holes and said auxiliary water holes simultaneously and led to said nozzles or auxiliary nozzles to spurt out.

* * * * *